US008852684B2

(12) United States Patent
Okabe et al.

(10) Patent No.: US 8,852,684 B2
(45) Date of Patent: Oct. 7, 2014

(54) FINISH FOR ACRYLIC FIBER PROCESSED INTO CARBON FIBER, AND CARBON FIBER MANUFACTURING METHOD THEREWITH

(75) Inventors: Yoshinobu Okabe, Yao (JP); Yoshiaki Tanaka, Yao (JP); Yoshio Hashimoto, Yao (JP); Mikio Nakagawa, Yao (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 1809 days.

(21) Appl. No.: 12/091,164

(22) PCT Filed: Nov. 16, 2006

(86) PCT No.: PCT/JP2006/323383

§ 371 (c)(1), (2), (4) Date: Apr. 22, 2008

(87) PCT Pub. No.: WO2007/066517

PCT Pub. Date: Jun. 14, 2007

(65) Prior Publication Data

US 2009/0263576 A1 Oct. 22, 2009

(30) Foreign Application Priority Data

Dec. 9, 2005 (JP) ..... 2005-380895

(51) Int. Cl.

| | |
|---|---|
| ***B05D 3/02*** | (2006.01) |
| ***C09D 1/00*** | (2006.01) |
| ***D06M 13/224*** | (2006.01) |
| ***D01F 11/06*** | (2006.01) |
| ***D01F 9/22*** | (2006.01) |
| ***D06M 13/00*** | (2006.01) |
| ***D06M 15/643*** | (2006.01) |
| *D06M 101/28* | (2006.01) |

(52) U.S. Cl.

CPC ..... *D01F 9/22* (2013.01); *D06M 2101/28* (2013.01); *D06M 13/224* (2013.01); *D01F 11/06* (2013.01); *D06M 7/00* (2013.01); *D06M 2200/40* (2013.01); *D06M 15/6436* (2013.01)

USPC ..... 427/228; 106/287.16

(58) Field of Classification Search

None

See application file for complete search history.

(56) References Cited

U.S. PATENT DOCUMENTS

| | | | |
|---|---|---|---|
| 4,944,932 | A | 7/1990 | Shiromoto et al. |
| 5,571,442 | A | 11/1996 | Masaki et al. |
| 5,783,305 | A | 7/1998 | Masaki et al. |

FOREIGN PATENT DOCUMENTS

| | | | |
|---|---|---|---|
| EP | 0102705 | B1 | 6/1988 |
| FR | 2593523 | A1 | 7/1987 |
| JP | S62-231078 | A | 10/1987 |
| JP | H06-220722 | A | 8/1994 |
| JP | H08-209543 | A | 8/1996 |
| JP | H11-117128 | A | 4/1999 |
| JP | 2000-199183 | A | 7/2000 |
| JP | 2001-172879 | A | 6/2001 |
| JP | 2002-266239 | A | 9/2002 |
| JP | 2002-371477 | A | 12/2002 |
| JP | 2003-201346 | A | 7/2003 |
| JP | 2004-143645 | A | 5/2004 |
| JP | 2004-211240 | A | 7/2004 |
| JP | 2004-244771 | A | 9/2004 |
| JP | 2005-89884 | A | 4/2005 |
| WO | WO-97-09474 | | 3/1997 |

*Primary Examiner* — John J Figueroa

(74) *Attorney, Agent, or Firm* — Global IP Counselors, LLP

(57) ABSTRACT

A finish for acrylic fiber to be processed into carbon fiber includes an ester compound having at least three ester groups in its molecule and a silicone compound, wherein the silicone compound constitutes 10 to 50 weight percent of the whole of the nonvolatile matter of the finish. A method of manufacturing carbon fiber includes the processes of applying the finish for acrylic fiber to be processed into carbon fiber to acrylic fiber to be processed into carbon fiber; oxidative-stabilizing the finish-applied acrylic fiber in an oxidizing atmosphere at 200 to 300 deg. C. to convert the fiber into oxidized fiber; and carbonizing the oxidized fiber in an inert atmosphere at 200 to 3000 deg. C.

29 Claims, No Drawings

FINISH FOR ACRYLIC FIBER PROCESSED INTO CARBON FIBER, AND CARBON FIBER MANUFACTURING METHOD THEREWITH

CROSS-REFERENCE TO RELATED APPLICATIONS

This U.S. National stage application claims priority under 35 U.S.C. §119(a) to Japanese Patent Application No. 2005-380895, filed in Japan on Dec. 9, 2005, the entire contents of which are hereby incorporated herein by reference.

TECHNICAL FIELD

The present invention relates to a finish for acrylic fiber to be processed into carbon fiber, and a method of manufacturing carbon fiber with the finish. Specifically, the present invention relates to a finish for acrylic fiber (hereinafter sometimes referred to as a precursor finish), which imparts excellent processability to acrylic fiber to be processed into carbon fiber (hereinafter sometimes referred to as a precursor); and a method of manufacturing carbon fiber with the finish.

TECHNICAL BACKGROUND

Carbon fiber is employed as a fiber for reinforcing a composite material called matrix resin owing to its excellent mechanical property, and is applied widely in various fields including aerospace industry, sports industry, and general industries.

A common method for manufacturing carbon fiber involves a process of converting a precursor into oxidized fiber in an oxidizing atmosphere at 200 to 300 deg. C. followed by the carbonization of the fiber in an inert atmosphere at 300 to 2,000 deg. C. Monofilaments sometimes fuse to each other during heating at such high temperature levels, and cause a problem, i.e., reduced quality and grade of resultant carbon fiber.

For preventing the fused monofilaments, a number of techniques to apply silicone finishes, which have excellent heat-resistance and impart fiber-to-fiber lubricity to attain excellent detaching properties on fiber, especially finishes comprising amino-modified silicone which cross-link to further improve their heat resistance, to a precursor have been suggested (refer to Patent References 1 to 6) and widely employed in industries.

[Patent Reference 1] JP A 6-220722
[Patent Reference 2] JP A 11-117128
[Patent Reference 3] JP A 2001-172879
[Patent Reference 4] JP A 2002-371477
[Patent Reference 5] JP A 2003-201346
[Patent Reference 6] JP A 2004-244771

On the other hand, silicone finishes applied to fiber sometimes fall from the fiber to turn into a tacky substance which deposits on drying rollers and guides in precursor production process and causes fiber wrapping or broken fiber to decrease manufacturing efficiency. In addition, parts of the silicone finishes are formed into silicon oxide in oxidizing atmosphere in oxidative stabilization process, and are formed into silicon nitride in an inert atmosphere in carbonization process when nitrogen is employed as the inert gas. The formed products, in other words, scale, deposit to reduce manufacturing efficiency and operating performance and to cause damage of a furnace, which are known as the associating problems.

Although excellent detaching properties on fiber owing to fiber-to-fiber lubricity imparted by silicone finishes are effective to prevent fusing between monofilaments, the fiber-to-fiber lubricity imparted by silicone finishes makes filament bundles spread to increase their width in heating process where number of filament bundles run parallel, leads to decreased space between adjacent filament bundles, and sometimes causes broken filaments due to the contact between adjacent filament bundles.

For avoiding such troubles, finishes containing less amount of silicone compounds or finishes free of silicone compounds have been suggested. The examples of such finishes include a finish formulated by combining a bisphenol-A-containing aromatic compound and an amino-modified silicone (refer to Patent References 7 to 10), and a finish containing a fatty acid ester of an alkylene-oxide adduct of bisphenol A as a major component (refer to Patent References 11 and 12).

Although the finishes are effective to prevent the above-mentioned troubles caused by silicone compounds in carbon fiber manufacturing, they have a shortage of poor safety in use due to bisphenol-A-containing compounds, which are suspected endocrine disrupters, contained in their formulae.

[Patent Reference 7] JP A 2000-199183
[Patent Reference 8] JP A 2002-266239
[Patent Reference 9] JP A 2004-211240
[Patent Reference 10] JP A 2005-89884
[Patent Reference 11] WO 97-09474
[Patent Reference 12] JP A 2004-143645

SUMMARY OF THE INVENTION

Technical Problem

The object of the present invention is to provide an acrylic-fiber finish for carbon-fiber production, the finish which satisfies both of the requirements for preventing fusing between monofilaments and stabilizing manufacturing performance (filament spinning efficiency and filament processability in heating) and is not a suspected endocrine disrupter; and a method of manufacturing carbon fiber with the finish.

Technical Solution

The inventors of the present invention have diligently worked to attain the above-mentioned object, and found that a finish essentially comprising an ester compound containing at least three ester groups in its molecule and a silicone compound can solve the problems mentioned above to reach the present invention.

The finish for acrylic fiber to be processed into carbon fiber of the present invention essentially comprises an ester compound containing at least three ester groups in its molecule and a silicone compound. The weight ratio of the silicone compound to the whole of the nonvolatile matter in the finish ranges from 10 to 50 weight percent. The ester compound is at least one compound selected from the group consisting of an ester compound (1) represented by the formula (1), an ester compound (2) represented by the formula (2) and an ester compound (3) represented by the formula (3).

Another finish for acrylic fiber to be processed into carbon fiber of the present invention essentially comprises an ester compound containing at least three ester groups in its molecule and a silicone compound. The weight ratio of the silicone compound to the whole of the non-volatile matter in the finish ranges from 10 to 50 weight percent, and the ester compound is obtained by hydrolyzing a polybasic acid and a higher alcohol.

The method of manufacturing carbon fiber of the present invention involves a finish-application process where the finish for acrylic fiber processed into carbon fiber mentioned above is applied to acrylic fiber to be processed into carbon fiber, an oxidative stabilization process where the finish-applied acrylic fiber is converted into oxidized fiber in an oxidizing atmosphere at 200 to 300 deg. C., and a carbonization process where the oxidized fiber is further carbonized in an inert atmosphere at 300 to 2000 deg. C.

Advantageous Effects

The finish for acrylic fiber to be processed into carbon fiber of the present invention satisfies both of the requirements for preventing fusing between monofilaments and stabilizing manufacturing performance (filament spinning efficiency and filament processability in heating), when the finish is previously applied to a precursor. Furthermore, the finish for acrylic fiber to be processed into carbon fiber is not a suspected endocrine disrupter.

In the method of manufacturing carbon fiber of the present invention, high-quality carbon fiber is manufactured owing to the application of the finish for acrylic fiber to be processed into carbon fiber.

DETAILED DESCRIPTION OF THE INVENTION

The finish for acrylic fiber to be processed into carbon fiber of the present invention (a precursor finish) is formulated for applying to acrylic fiber to be processed into carbon fiber (carbon fiber precursor). The following description at first explains each component constituting the finish for acrylic fiber to be processed into carbon fiber.

[Ester Compound]

The ester compound contains at least three ester groups in its molecule, and is an essential constituent of the precursor finish of the present invention. The ester compound functions to improve the filament processability in heating in carbon fiber manufacturing without reducing filament-spinning efficiency. The ester compound has excellent heat resistance to remain on fiber in oxidative stabilization process together with a silicone compound mentioned below so as to prevent monofilaments from fusing. In addition, the ester compound imparts high fiber-to-fiber friction to improve the cohesion of filament bundles and attain sufficient filament processability in heating.

The ester compound is not specifically restricted so far as it is a compound containing at least three ester groups in its molecule. Examples of the ester compound include an ester compound containing at least three ester groups in its molecule in which one of the ester groups is bonded to other ester groups only through a carbon-carbon bond. Such ester compound is produced by several methods, for example, dehydration reaction of a polybasic acid and a higher alcohol, or dehydration reaction of a polyhydric alcohol and a fatty acid.

Examples of the ester compound include an ester compound (1) represented by the following formula (1), an ester compound (2) represented by the following formula (2), an ester compound (3) represented by the following formula (3), and a compound formed by esterifying six hydroxide groups of dipentaerythritol. One of or at least two of those ester compounds may be employed.

(1)

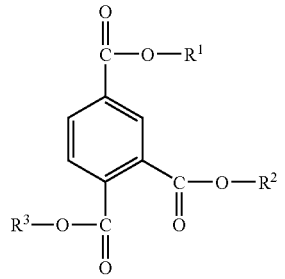

(wherein $R^1$, $R^2$, and $R^3$ are $C_{8-22}$ hydrocarbon groups, and may be the same or different groups)

(2)

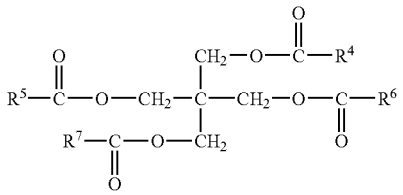

(wherein $R^4$, $R^5$, $R^6$, and $R^7$ are $C_{15-21}$ groups, and may be the same or different groups)

(3)

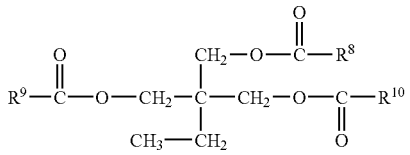

(wherein $R^8$, $R^9$, and $R^{10}$ are $C_{15-21}$ hydrocarbon groups, and may be the same or different groups).

Among those ester compounds, at least one compound selected from the group consisting of the ester compound (1), the ester compound (2), and the ester compound (3) is preferable, because the compound has excellent heat resistance and is highly effective to prevent fiber-to-fiber fusing and retain the cohesion of filament bundles in the oxidative stabilization process of the method of manufacturing carbon fiber mentioned below.

The ester compound (1) is produced in a known method, such as dehydration reaction of trimellitic acid and a higher alcohol. The $R^1$ to $R^3$ of the ester compound (1) are $C_{8-22}$ (preferably $C_{10-13}$) hydrocarbon groups, and may be linear or branched. The $R^1$ to $R^3$ include, for example, 2-ethylhexyl group, isodecyl group, lauryl group, isotridecyl group, stearyl group, isostearyl group, and oleyl group.

The specific examples of the ester compound (1) are tri-2-ethylhexyl trimellitate, triisodecyl trimellitate, and triisotridecyl trimellitate. One of or at least two of the ester compounds (1) may be employed.

The ester compound (2) is produced in a known method, for example, dehydration reaction of pentaerythritol and a higher fatty acid. The $R^4$ to $R^7$ of the ester compound (2) are $C_{15-21}$ (preferably $C_{15-17}$) hydrocarbon groups, and may be linear or branched. In addition, the $R^4$ to $R^7$ may be saturated hydrocarbon groups or unsaturated hydrocarbon groups. The $R^4$ to $R^7$ include, for example, hydrocarbon groups having a structure obtained by removing a carboxyl group from a higher fatty acid, such as caprylic acid, lauric acid, palmitic acid, stearic acid, isostearic acid, oleic acid, and behenic acid. Among those $R^4$ to $R^7$, hydrocarbon groups having a structure obtained by removing a carboxyl group from a higher fatty acid, such as stearic acid, isostearic acid, and oleic acid are preferable because of their heat resistance.

The specific examples of the ester compound (2) are pentaerythritol tetralaurate, pentaerythritol tetrastearate, pentaerythritol tetraisostearate, and pentaerythritol tetraoleate. One of or at least two of the ester compounds (2) may be employed.

The ester compound (3) is produced in a known method, such as dehydration reaction of trimethylol propane and a higher fatty acid. The $R^8$ to $R^{10}$ of the ester compound (3) are $C_{15-21}$ (preferably $C_{15-17}$) hydrocarbon groups, and may be linear or branched. In addition, the $R^8$ to $R^{10}$ may be saturated hydrocarbon groups or unsaturated hydrocarbon groups. The $R^8$ to $R^{10}$ include the same hydrocarbon groups mentioned as the examples of $R^4$ to $R^7$ in the above description, and preferable groups are also the same.

The specific examples of the ester compound (3) are trimethylolpropane trilaurate, trimethylolpropane tristearate, trimethylolpropane triisostearate, and trimethylolpropane trioleate. One of or at least two of the ester compounds (3) may be employed.

[Silicone Compound]

The silicone compound is an essential constituent of the precursor finish of the present invention, and improves the tenacity of carbon fiber in carbon fiber manufacturing with its excellent performance to prevent monofilament fusing.

The silicone compound is not specifically restricted so far as it is an organosiloxane compound containing a plurality of silicone bonds (—O—Si—O—) in its molecule. Modified silicones such as an amino-modified silicone, epoxy-modified silicone, or alkylene-oxide-modified silicone, and their mixture are preferable for their cross-linking behavior in oxidative stabilization process to improve their heat resistance; and an amino-modified silicone is more preferable.

An amino group functioning as a modifier group in an amino-modified silicone may bond either to a side chain or terminal, or both of them of a principal chain, a silicone. The amino group may be either monoamine or polyamine, and both of them may be contained in a molecule of an amino-modified silicone.

The viscosity of an amino-modified silicone at 25 deg. C. is not specifically restricted, and should preferably range from 500 to 15,000 $mm^2$/sec, more preferably from 800 to 10,000 $mm^2$/sec, and further more preferably from 1,000 to 5,000 $mm^2$/sec, for preventing the amino-modified silicone from scattering in oxidative stabilization process or gumming up in finish-application process.

The amine equivalent of an amino-modified silicone is not specifically restricted. However, the amine equivalent should range preferably from 500 to 10,000 g/mol, more preferably from 1,000 to 5,000 g/mol, and further more preferably from 1,500 to 2,000 g/mol, for the purpose of controlling the gumming up of an amino-modified silicone in finish-application process, which results from excessive cross-linking of the silicone on finish-applied fiber in drying, and preventing poor heat resistance of cross-linked amino-modified silicone which results from its insufficient cross-linking.

[Antioxidant]

The antioxidant effectively controls thermal degradation of a precursor finish caused by heating in oxidative stabilization process, and enhances the effect of the finish to prevent monofilament fusing.

The antioxidant is not specifically restricted, and an organic antioxidant is preferable for preventing contamination in furnaces. The organic antioxidant includes, for example, 4,4'-butylidene bis(3-methyl-6-t-butyl phenol, trioctadecyl phosphite, N,N'-diphenyl-p-phenylenediamine, triethylene glycol bis[3-(3-t-butyl-4-hydroxy-5-methylphenyl) propionate], and dioleyl-thiodipropionate. One of or at least two of the organic antioxidants may be employed.

[Surfactant]

The surfactant is used as an emulsifier to emulsify or disperse a precursor finish in water so as to improve finish uniformity on fiber and safety in working environment.

The surfactant is not specifically restricted, and a known surfactant may be properly selected among nonionic surfactants, anionic surfactants, cationic surfactants, and amphoteric surfactants, and used. One of or at least two of the surfactants may be employed.

The nonionic surfactants include, for example, nonionic surfactants of alkylene-oxide adducts (alkylene oxide adducts obtained by addition-reacting at least one alkylene oxide variant, such as ethylene oxide and propylene oxide, to a higher alcohol, higher fatty acid, alkyl phenol, styrenated phenol, benzyl phenol, sorbitan, sorbitan ester, castor oil, and hydrogenated castor oil), a product obtained by addition-reacting a higher fatty acid to a polyalkylene glycol, and ethylene-oxide-propylene-oxide copolymers.

The anionic surfactants include, for example, carboxylates (salts), sulfate salts of higher alcohols and higher alcohol ethers, sulfonate salts, and phosphate salts of higher alcohols and higher alcohol ethers.

The cationic surfactants include, for example, cationic surfactants of quaternary ammonium salts (lauryltrimethylammonium chloride, oleylmethylethyl ammonium ethosulfate, etc.), and cationic surfactants of amine salts (polyoxyethylene laurylamine lactic acid salt, etc.).

The amphoteric surfactants include, for example, amphoteric surfactants of amino acids (sodium laurylaminopropionate, etc.), and amphoteric surfactants of betaines (stearyldimethyl betaine, laurylhydroxyethyl betaine, etc.).

[Precursor Finish]

The precursor finish of the present invention essentially comprises an ester compound and a silicone compound.

The weight ratio of the ester compound to the whole of nonvolatile components in the precursor finish of the present invention is not specifically restricted, and should range preferably from 40 to 90 weight percent and more preferably from 50 to 80 weight percent, for balancing filament spinning efficiency, filament processability in heating, and effect for preventing monofilament fusing in carbon fiber manufacturing.

A ratio of an ester compound greater than 90 weight percent consequently makes the ratio of another essential component, a silicone compound, less than 10 weight percent, and it results in insufficient effect for preventing monofilament fusing. On the other hand, insufficient weight ratio of an ester compound may result in insufficient cohesion of filament bundles in oxidative stabilization process so as to fail to attain sufficient filament processability in heating. However, a ratio of an ester compound lower than 40 weight percent may be selected when the tenacity of carbon fiber is prior to filament processability in heating, in the relation with the weight ratio of an silicone compound which is mentioned below.

The nonvolatile matter in the present invention means the bone-dry matter obtained by heating a finish at 105 deg. C. to remove solvents until the residue reaches to constant weight.

The weight ratio of a silicone compound to the whole of the nonvolatile matter in the precursor finish of the present invention is not specifically restricted, and should range preferably from 10 to 50 weight percent, more preferably from 15 to 50 weight percent, further preferably from 15 to 40 weight percent, and further more preferably from 20 to 40 weight percent, for balancing filament spinning efficiency, filament processability in heating, and effect for preventing monofilament fusing in carbon fiber manufacturing.

Excessive weight ratio of a silicone compound may reduce filament spinning efficiency and filament processability in heating. On the other hand, insufficient weight ratio of a silicone compound may result in insufficient effect for preventing monofilament fusing to cause low tenacity of resultant carbon fiber.

The weight ratio of an ester compound to a silicone compound (the ratio between ester compound and silicone compound contained in the precursor finish of the present invention is not specifically restricted, and the ratio should range preferably from 90:10 to 20:80, more preferably from 70:30 to 30:70, and further more preferably from 60:40 to 40:60, for balancing filament spinning efficiency, filament processability in heating, and effect for preventing monofilament fusing in carbon fiber manufacturing.

Excessive ester compound/silicone compound ratio may lead to insufficient effect for preventing monofilament fusing, and may cause low tenacity of resultant carbon fiber. On the other hand, insufficient ester compound/silicone compound ratio may lead to poor filament spinning efficiency and filament processability in heating.

The precursor finish of the present invention may further contain an antioxidant. The weight ratio of the antioxidant to the whole of the nonvolatile matter in the precursor finish is not specifically restricted, and should range preferably from 0.1 to 10 weight percent, and more preferably from 0.5 to 5 weight percent, for controlling thermal degradation of the finish and stabilizing the emulsion of the finish.

The precursor finish of the present invention may further contain a surfactant. The precursor finish should preferably be an aqueous emulsion being emulsified or dispersed in water with a surfactant contained as an emulsifier, for the purpose of uniform finish distribution on fiber and safety in working environment.

If the precursor finish of the present invention contains water, the weight ratio of the water is not specifically restricted, and may be determined according to the cost for transporting the precursor finish of the present invention or the handling property relating to the viscosity of emulsified finish. The weight ratio of water in the whole of the precursor finish should range preferably from 0.1 to 99.9 weight percent, more preferably from 10 to 99.5 weight percent, and further more preferably from 50 to 99 weight percent.

The weight ratio of a surfactant to the whole of the nonvolatile matter in the precursor finish of the present invention is not specifically restricted, and should range preferably from 5 to 40 weight percent, and more preferably from 10 to 30 weight percent, for stabilizing finish emulsion and retaining the heat resistance of the finish.

The precursor finish of the present invention may contain an antistat, such as sulfate salts of higher alcohols and higher alcohol ethers, sulfonate salts, phosphate salts of higher alcohols and higher alcohol ethers, cationic surfactants of quaternary ammonium salts, and cationic surfactants of amine salts; a lubricant, such as alkyl esters of higher alcohols, higher alcohol ethers, and waxes; antibacterial agents; antiseptics; rust-preventive agents; and moisture absorbents; in an amount which does not inhibit the effect of the present invention.

The precursor finish of the present invention is formulated by blending the components described above. For making a precursor finish in a state of composition prepared by dispersing or emulsifying finish components in water, the method for dispersing and emulsifying the above-mentioned finish components is not specifically restricted, and known methods may be employed. The methods include, for example, dispersing and emulsifying finish components constituting a precursor finish by adding each of them to warm water with agitation, or emulsifying finish components constituting a precursor finish in phase conversion emulsification where the mixture of the components is subjected to mechanical shear with a homogenizer, homo-mixer, or ball mill, and water is gradually added to the mixture.

The weight loss of the precursor finish of the present invention is not specifically restricted, and preferable weight loss after heating at 250 deg. C. for 1 hour in the air should be below 30%, more preferably below 20%, further more preferably below 15%, and most preferably below 10%, considering the heat resistance of the precursor finish and its effect to prevent monofilament fusing in oxidative stabilization process. A thermal weight loss over 30% result in insufficient amount of finish film left on fiber surface in oxidative stabilization process, and may fail to attain sufficient effect to prevent monofilament fusing.

Carbon fiber is manufactured with the precursor finish of the present invention. The method of manufacturing carbon fiber with the precursor finish of the present invention is not specifically restricted, and includes the method described below.

[Method of Manufacturing Carbon Fiber]

The carbon fiber manufacturing method of the present invention involves finish application process, oxidative stabilization process, and carbonization process.

In the finish application process, acrylic fiber to be processed into carbon fiber (precursor) is spun, and the resultant precursor is dressed with a finish for acrylic fiber to be processed into carbon fiber (a precursor finish). In other words, a precursor finish is applied to precursor in the finish application process.

Precursor comprises an acrylic fiber containing polyacrylonitrile, which is obtained by copolymerizing at least 95 mol % of acrylonitrile and 5 mol % or less of an oxidation-promoting component, as a major component. A preferable oxidation-promoting component is a compound containing a vinyl group, which is copolymerizable with acrylonitrile. The thickness of precursor monofilament is not specifically restricted, and should preferably range from 0.1 to 2.0 dtex to balance carbon fiber performance and manufacturing cost. The number of monofilaments constituting a precursor strand is not specifically restricted, and should preferably range from 1,000 to 96,000 to balance carbon fiber performance and manufacturing cost.

A precursor finish may be applied to precursor at any step in the finish application process. In other words, a precursor finish may be applied to freshly spun precursor, precursor after drawing, or precursor at takeup step subsequent to the drawing. In the application of a precursor finish, rollers may be employed for neat finish application with a precursor finish constituting only nonvolatile components, and bath immersion or spray method may be employed for applying finish emulsion prepared by dispersing or emulsifying a precursor finish in water or an organic solvent.

In the finish application process, the pickup of a precursor finish should preferably range from 0.1 to 2 weight percent, more preferably from 0.3 to 1.5 weight percent, for balancing the effect to prevent monofilament fusing and the effect to prevent the reduction of carbon fiber quality caused by coked finish in carbonization process. A pickup of a precursor finish less than 0.1 weight percent fail to sufficiently prevent monofilament fusing and may reduce the tenacity of resultant carbon fiber. On the other hand, a pickup of a precursor finish greater than 2 weight percent results in excessively coated monofilament surface which inhibits oxygen supply to monofilament in oxidative stabilization process, and may also reduce the tenacity of resultant carbon fiber. The pickup of a precursor finish mentioned here means the percentage of the weight of nonvolatile components in a precursor finish applied to a precursor to the weight of the precursor.

In the oxidative stabilization process, acrylic filament after finish application (acrylic filament applied with a precursor finish) is converted into oxidized fiber at 200 to 300 deg. C. in an oxidizing atmosphere. The air may be usually employed for the oxidizing atmosphere, and the temperature of the oxidizing atmosphere should preferably range from 230 to 280 deg. C. In the oxidative stabilization process, finish-applied acrylic filament is heated for 20 to 100 minutes (preferably for 30 to 60 minutes), being tensioned with a draw ratio from 0.90 to 1.10 (preferably from 0.95 to 1.05). In the oxidative stabilization process, oxidized filament having heat-resistant structure is manufactured through the steps of cyclization in a molecule of the filament and addition-reaction of oxygen to the cycle.

In the present invention, the bending strength of oxidized filament tested in the method described below should preferably be 40 g or higher for attaining sufficient cohesion of filament bundles in oxidative stabilization process. In this case, the pickup of a precursor finish should preferably range from 0.90 to 1.10 weight percent, though it is not restricted specifically.

The bending strength indicates the cohesion of filament bundles in oxidative stabilization process. A bending strength of 40 g or higher represents that the viscosity of a finish on filament or friction between monofilaments is high enough when a finish-applied precursor is heated to be oxidized. Thus the high friction between monofilaments attains sufficient cohesion of filament bundles and satisfactory processability of filament in heating.

In the determination of the bending strength, a filament sample having proper thickness like as that described in Examples is preferable to obtain an oxidized filament sample subjected to the determination easily and reproducibly. The oxidative stabilization is carried out at 250 deg. C. for 1 hour with 230 g tension for constant treatment.

In carbonization process, oxidized filament is carbonized at 300 to 2,000 deg. C. in an inert atmosphere. In carbonization process, it is preferable to carry out, at first, preliminary carbonization (primary carbonization) by heating an oxidized filament for several minutes with a tension of 0.95 to 1.15 draw ratio in an inert atmosphere of nitrogen or argon in a furnace having a temperature gradient ranging from 300 to 800 deg. C. Then the secondary carbonization is carried out by heating the fiber for several minutes with a tension of 0.95 to 1.05 draw ratio comparing to that given to the fiber in the primary carbonization process in an inert atmosphere of nitrogen or argon for the purpose of advancing the carbonization and also graphitization to carbonize the oxidized filament. The heating temperature in the secondary carbonization should preferably be controlled by gradually raising it to a maximum temperature, 1,000 deg. C. or more (preferably from 1,000 to 2,000 deg. C.). The maximum temperature should be properly selected and determined according to the required property of intended carbon fiber (tensile strength, elastic modulus, etc.).

In the method of manufacturing carbon fibers of the present invention, graphitization process may be carried out following to the carbonization process, when carbon fibers having higher elastic modulus are required. The graphitization process is usually carried out in an inert atmosphere of nitrogen or argon at 2,000 to 3,000 deg. C. by tensioning filament after carbonization process.

Carbon fibers obtained in such manner may be treated on their surface to increase its adhesion strength with a matrix resin, which forms a composite material with the carbon fiber, according to application fields. Gas-phase or liquid-phase treatment may be employed for the surface treatment, and liquid-phase treatment with a solution of an electrolyte, such as an acid or alkali, is preferable for production efficiency. Furthermore, various sizing agents having excellent compatibility to matrix resins may be applied to carbon fiber for improving the processability and handling property of the carbon fiber.

EXAMPLE

The present invention is described specifically with the following examples, though the present invention is not restricted within the scope of those examples. The percentage (%) described in the following examples represents weight percent so far as it is not specifically restricted. The measurement of each property was carried out based on the methods described below.

[Pickup of a Precursor Finish]

A precursor sample applied with a precursor finish and conditioned to a constant weight was treated in alkaline fusion with potassium hydroxide and sodium butyrate, and dissolved in water. Then the pH of the resultant solution was controlled at 1 with hydrochloric acid. The solution was colored with sodium sulfite and ammonium molybdate to be subjected to colorimetric determination of silicic molybdenum blue which shows its peak at 815 nm wave length to determine the amount of silicon contained. Then the amount of a precursor finish on the precursor sample was calculated with the amount of silicone determined here and the amount of silicon in the precursor finish which was previously determined in the same manner. The pickup of the silicone-free finish in Comparative Examples 2 and 3 was calculated from the result obtained by extracting the precursors with a Soxhlet extraction apparatus and ethanol.

[Filament Spinning Efficiency (Stain on Roller)]

The degree of stain (gumming up) on a drying roller after applying a finish to 50 kg of a precursor was evaluated with the following criteria.

◎: no stain on roller due to gumming up to cause no problems in filament spinning efficiency ○: a little stain on roller due to gumming up to cause no problems in filament spinning efficiency Δ: some stain on roller due to gumming up to cause no problems in filament spinning efficiency X: stain on roller due to gumming up to cause a little poor filament spinning efficiency X X: a lot of stain on roller due to gumming up to cause monofilament separation and wrapping in filament spinning

[Filament Processability in Heating (Filament Cohesion)]

In oxidative stabilization process, the state of stabilized filament bundles freshly coming out from a stabilizing furnace was evaluated with the following criteria.

○: sufficient cohesion of filament bundles without contact to adjacent bundles to attain smooth operation X: spread filament bundles to partly contact adjacent bundles and sometimes to cause broken filament

[Effect to Prevent Filament Fusing]

After carbonization process, twenty points on carbon fiber were randomly selected, and a 10-mm short fiber strand was cut out at each point. The fusing of each short fiber strand was checked and evaluated with the following criteria.

◎: no fusing

○: almost no fusing

Δ: a little fusing

X: a lot of fusing

[Tenacity of Carbon Fiber]

The tenacity of a carbon fiber was measured according to the testing method for epoxy-impregnated strand defined in JIS-R-7601, and the average of ten times of measurement was determined as the tenacity of the carbon fiber tested.

[Heat Resistance of Finish (Weight Loss)]

A precursor finish was weighed in an aluminum cup of 60 mm diameter in an amount containing 1 g of nonvolatile matter, and the weighed finish was dried in an oven at 105 deg. C. for 3 hours to remove water. Then the dried sample (1 g) was heated in a Geer oven at 250 deg. C. for 1 hour. The percentage of the reduced weight of the heated finish to the weight of the finish before the heating was defined as weight loss. Smaller weight loss indicates better heat resistance of the finish.

[Tenacity of Oxidized Yarn]

An acrylic filament bundle comprising 120 strands of 5.5 dtex acrylic monofilament was applied with a precursor finish to 1.0% finish pickup. Three strands of the resultant finish-applied filament bundle (each about 50 cm long) were plied, and the plied strand was loaded by clamping one end and hanging a 230-g weight on the other end. The loaded strand was twisted at a rate of 60 turns/m, and fixed with a clamp being loaded with the 230 g weight. The twisted and loaded strand was heated in a Geer oven at 250 deg. C. for 1 hour to be made into stabilized yarn. The bending strength of the resultant stabilized yarn was measured with a handle-o-meter (HOM-2, having a 5-mm wide slit, manufactured by Daiei Kagaku Seiki Mfg. Co., Ltd.). The measurement was carried out ten times, and the average of the results was determined as the tenacity of the stabilized yarn.

Example 1

An ester compound, M-1, represented by the formula (1) in which $R^1$, $R^2$ and $R^3$ are $C_{10}$ isodecyl groups, and an amino-modified silicone, S-1 (having a viscosity of 1300 $mm^2/s$ at 25 deg. C. and an amine equivalent of 2000 g/mol), as a silicone compound, were emulsified in water with nonionic surfactants (POE(7) $C_{12-14}$ alkyl ether and POE(20) castor wax) to be made into a finish emulsion (precursor finish) containing nonvolatile finish components, M-1, S-1, and the nonionic surfactants, in the weight ratio of 64:16:20 (weight percent). The concentration of the nonvolatile finish components in the emulsion was controlled at 3.0 weight percent.

The finish emulsion was applied to a precursor (24,000 f, consisting of 0.8 dtex monofilament) to 1.0% pickup, and the precursor was dried at 100 to 140 deg. C. to remove water. The finish-applied precursor was then stabilized in a stabilizing furnace at 250 deg. C. for 60 minutes, and then converted into carbon fiber by heating in nitrogen atmosphere in a carbonizing furnace having a temperature gradient from 300 to 1400 deg. C. The properties of the resultant precursor and carbon fiber are described in Table 1.

Examples 2 to 9 and Comparative Examples 1 to 5

In Examples 2 to 9 and Comparative Examples 1 to 5, each of finish-applied precursors and carbon fibers was prepared in the same manner as in Example 1 except that a finish emulsion was prepared to contain each combination of the nonvolatile finish components (weight percent) shown in Tables 1 to 3. The properties of the resultant precursors and carbon fibers are described in Tables 1 to 3 in the same manner as in Example 1.

As clearly shown in the following Tables 1 to 3, the precursor finishes in Examples attain both excellent filament spinning efficiency and effect to prevent monofilament fusing, being different from those in Comparative Examples. The tenacity of resultant carbon fibers was similar to that in Comparative Example 1 where only a finish comprising silicone was applied.

TABLE 1

| | | Examples | | | | |
|---|---|---|---|---|---|---|
| | | 1 | 2 | 3 | 4 | 5 |
| Ester compounds (%) | M-1 | 64 | 40 | — | — | — |
| | M-2 | — | — | 70 | 64 | 40 |
| | M-3 | — | — | — | — | — |
| | M-4 | — | — | — | — | — |
| Silicone compound S-1 (%) | | 16 | 40 | 10 | 16 | 40 |
| Nonionic surfactant (%) | | 20 | 20 | 20 | 20 | 20 |
| Antioxidant (%) | | — | — | — | — | — |
| Finish pickup (%) | | 1.0 | 1.1 | 1.2 | 1.0 | 1.0 |
| Filament spinning efficiency | | ○ | ○ | ◎ | ○ | ○ |
| Filament processability in heating | | ○ | ○ | ○ | ○ | ○ |
| Effect to prevent monofilament fusing | | ○ | ◎ | ○ | ○ | ◎ |
| Carbon fiber tenacity (GPa) | | 4.9 | 5.1 | 4.8 | 5.0 | 5.2 |
| Weight loss (%) | | 14.3 | 10.5 | 19.5 | 11.5 | 6.7 |
| Tenacity of oxidized fiber (g) | | 59.5 | 56.0 | 64.3 | 62.1 | 57.8 |

TABLE 2

| | | Examples | | | |
|---|---|---|---|---|---|
| | | 6 | 7 | 8 | 9 |
| Ester compounds (%) | M-1 | — | — | — | 30 |
| | M-2 | 63 | — | — | — |
| | M-3 | — | 64 | — | — |
| | M-4 | — | — | 56 | — |
| Silicone compound S-1 (%) | | 15 | 16 | 24 | 50 |
| Nonionic surfactant (%) | | 20 | 20 | 20 | 20 |
| Antioxidant (%) | | 2 | — | — | — |
| Finish pickup (%) | | 1.1 | 0.9 | 1.1 | 1.0 |
| Filament spinning efficiency | | ○ | ○ | ○ | ○ |
| Filament processability in heating | | ○ | ○ | ○ | ○ |
| Effect to prevent monofilament fusing | | ○ | ○ | ◎ | ◎ |
| Carbon fiber tenacity (GPa) | | 5.2 | 5.0 | 4.9 | 5.4 |
| Weight loss (%) | | 8.9 | 17.4 | 18.1 | 12.9 |
| Tenacity of oxidized fiber (g) | | 63.0 | 55.4 | 46.7 | 44.2 |

TABLE 3

| | | Comparative Examples | | | | |
|---|---|---|---|---|---|---|
| | | 1 | 2 | 3 | 4 | 5 |
| Ester compounds (%) | M-1 | — | 80 | — | — | — |
| | M-2 | — | — | 80 | 75 | 15 |
| | M-3 | — | — | — | — | — |
| | M-4 | — | — | — | — | — |
| Silicone compound S-1 (%) | | 78 | — | — | 5 | 65 |
| Nonionic surfactant (%) | | 20 | 20 | 20 | 20 | 20 |
| Antioxidant (%) | | 2 | — | — | — | — |
| Finish pickup (%) | | 1.2 | 1.0 | 1.1 | 1.2 | 1.1 |
| Filament spinning efficiency | | X | ◎ | ◎ | ◎ | Δ |
| Filament processability in heating | | X | ○ | ○ | ○ | X |

TABLE 3-continued

| | Comparative Examples | | | | |
|---|---|---|---|---|---|
| | 1 | 2 | 3 | 4 | 5 |
| Effect to prevent monofilament fusing | ◎ | X | X | X | ◎ |
| Carbon fiber tenacity (GPa) | 5.0 | 3.5 | 3.6 | 4.1 | 5.0 |
| Weight loss (%) | 27.8 | 36.1 | 17.8 | 26.4 | 8.6 |
| Tenacity of oxidized fiber (g) | 32.0 | 68.5 | 59.2 | 49.7 | 35.1 |

In Tables 1 to 3 described above, the numbers given to the components formulated into a finish represent the ratio of nonvolatile matter (weight percent).

M-1: an ester compound represented by the formula (1), wherein $R^1$, $R^2$ and $R^3$ are $C_{10}$ isodecyl group M-2: an ester compound represented by the formula (2), wherein $R^4$, $R^5$, $R^6$ and $R^7$ are $C_{17}$ residual groups obtained by removing carboxyl group from oleic acid M-3: an ester compound represented by the formula (2), wherein $R^4$, $R^5$, $R^6$ and $R^7$ are $C_{17}$ residual groups obtained by removing carboxyl group from isostearic acid M-4: an ester compound represented by the formula (3), wherein $R^8$. $R^9$ and $R^{10}$ are $C_{17}$ residual groups obtained by removing carboxyl group from isostearic acid S-1: amino-modified silicone (having a viscosity of 1300 $mm^2/s$ at 25 deg. C. and an amine equivalent of 2000 g/mol)

Nonionic surfactant: POE (7) $C_{12-14}$ alkyl ether and POE (20) castor wax

Antioxidant: triethyleneglycol bis[3-(3-t-butyl-4-hydroxy-5-methylphenyl) propionate]

INDUSTRIAL APPLICABILITY

The finish for acrylic fiber to be processed into carbon fibers are a treatment composition to be applied to acrylic fiber (precursor) which is processed into carbon fibers, and is effective for manufacturing high quality carbon fibers.

The method of manufacturing carbon fibers of the present invention can manufacture high quality carbon fibers.

What is claimed is:

1. An acrylic-fiber finish for carbon-fiber production, the finish which essentially comprises an ester compound having at least three ester groups in its molecule, a surfactant; and a silicone compound, wherein the silicone compound constitutes 10 to 50 weight percent of the whole of the nonvolatile matter of the finish, and the ester compound is a dehydrate of a polybasic acid and a higher alcohol, wherein the finish loses less than 30 percent of its weight after heating in the air at 250 deg. C. for 1 hour.

2. An acrylic-fiber finish for carbon-fiber production according to claim 1, wherein the ester compound has a structure in which one of its ester groups is bonded to any of other ester groups only through a carbon-carbon bond.

3. An acrylic-fiber finish for carbon-fiber production, the finish which essentially comprises an ester compound, and a silicone compound, wherein the silicone compound constitutes 10 to 50 weight percent of the whole of the nonvolatile matter of the finish, wherein the ester compound is an ester compound (1) represented by the formula (1) shown below (1)

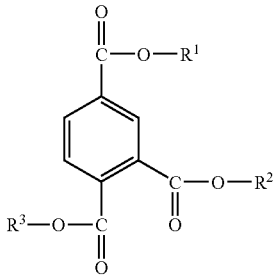

(wherein $R^1$, $R^2$, and $R^3$ are $C_{8-22}$ hydrocarbon groups respectively, and may be the same or different groups).

4. An acrylic-fiber finish for carbon-fiber production according to claim 3, wherein $R^1$, $R^2$, and $R^3$ in the above-mentioned formula contain 10 to 13 carbon atoms.

5. An acrylic-fiber finish for carbon-fiber production according to claim 1, wherein the silicone compound is an amino-modified silicone.

6. An acrylic-fiber finish for carbon-fiber production according to claim 1, the finish which further comprises an antioxidant constituting 0.1 to 10 weight percent of the whole of the nonvolatile matter of the finish.

7. An acrylic-fiber finish for carbon-fiber production according to claim 1, which is applied to an acrylic filament by 0.90 to 1.10 weight percent pickup to obtain an oxidized filament having a bending strength not lower than 40 g.

8. An acrylic-fiber finish for carbon-fiber production according to claim 1, the finish which is formed into an aqueous emulsion.

9. A method of manufacturing carbon fiber comprising the steps of applying a finish for acrylic fiber to be processed into carbon fiber according to claim 1 to acrylic fiber to be processed into carbon fiber; oxidative-stabilizing the finish-applied acrylic fiber in an oxidizing atmosphere at 200 to 300 deg. C. to convert the fiber into oxidized fiber; and carbonizing the oxidized fiber in an inert atmosphere at 200 to 3000 deg. C.

10. A method of manufacturing carbon fiber according to claim 9, wherein an oxidized fiber obtained after the oxidative-stabilizing step has a bending strength not lower than 40 g.

11. An acrylic-fiber finish for carbon-fiber production comprises a silicone compound, a surfactant and an ester compound which is at least one compound selected from the group consisting of an ester compound (1) represented by the formula (1), an ester compound (2) represented by the formula (2), and an ester compound (3) represented by the formula (3)

(1)

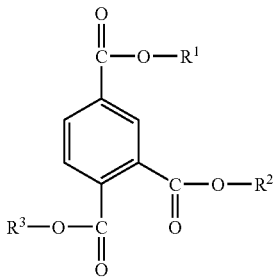

(wherein $R^1$, $R^2$, and $R^3$ are $C_{8-22}$ hydrocarbon groups, and may be the same or different groups)

(2)

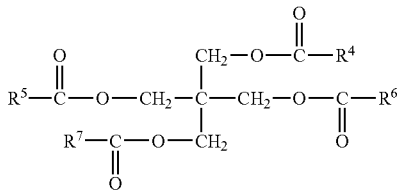

(wherein $R^4$, $R^5$, $R^6$, and $R^7$ are $C_{15-21}$ hydrocarbon groups, and may be the same or different groups)

(3)

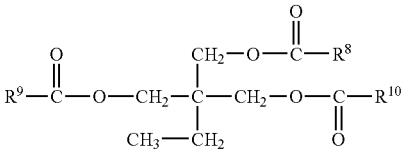

(wherein $R^8$, $R^9$, and $R^{10}$ are $C_{15-21}$ hydrocarbon groups, and may be the same or different groups), the silicone compound constitutes 10 to 50 weight percent of the whole of a nonvolatile matter of the finish, and wherein the finish loses less than 30 percent of its weight after heating in the air at 250 deg. C. for 1 hour.

12. An acrylic-fiber finish for carbon-fiber production according to claim 11, wherein $R^1$, $R^2$, and $R^3$ contain 10 to 13 carbon atoms, and $R^4$, $R^3$, $R^6$, $R^7$, $R^8$, $R^9$, and $R^{10}$ contain 15 to 17 carbon atoms in the above-mentioned formulae.

13. An acrylic-fiber finish for carbon-fiber production according to claim 11, wherein the silicone compound is an amino-modified silicone.

14. An acrylic-fiber finish for carbon-fiber production according to claim 11, the finish which further comprises an antioxidant constituting 0.1 to 10 weight percent of the whole of the nonvolatile matter of the finish.

15. An acrylic-fiber finish for carbon-fiber production according to claim 11, which is applied to an acrylic filament by 0.90 to 1.10 weight percent pickup to obtain an oxidized filament having a bending strength not lower than 40 g.

16. An acrylic-fiber finish for carbon-fiber production according to claim 11, the finish which is formed into an aqueous emulsion.

17. A method of manufacturing carbon fiber comprising the steps of applying a finish for acrylic fiber to be processed into carbon fiber according to claim 11 to acrylic fiber to be processed into carbon fiber; oxidative-stabilizing the finish-applied acrylic fiber in an oxidizing atmosphere at 200 to 300 deg. C. to convert the fiber into oxidized fiber; and carbonizing the oxidized fiber in an inert atmosphere at 200 to 3000 deg. C.

18. A method of manufacturing carbon fiber according to claim 17, wherein an oxidized fiber obtained after the oxidative-stabilizing step has a bending strength not lower than 40 g.

19. An acrylic-fiber finish for carbon-fiber production according to claim 1, wherein the surfactant constitutes 5 to 40 weight percent of the whole of a nonvolatile matter of the finish, and includes a nonionic surfactant.

20. An acrylic-fiber finish for carbon-fiber production according to claim 3, the finish which further comprises a surfactant.

21. An acrylic-fiber finish for carbon-fiber production according to claim 20, wherein the surfactant constitutes 5 to 40 weight percent of the whole of a nonvolatile matter of the finish, and includes a nonionic surfactant.

22. An acrylic-fiber finish for carbon-fiber production according to claim 3, wherein the silicone compound is an amino-modified silicone.

23. An acrylic-fiber finish for carbon-fiber production according to claim 3, the finish which further comprises an antioxidant constituting 0.1 to 10 weight percent of the whole of the nonvolatile matter of the finish.

24. An acrylic-fiber finish for carbon-fiber production according to claim 3, the finish which loses its weight less than 30 percent after heating in the air at 250 deg. C. for 1 hour.

25. An acrylic-fiber finish for carbon-fiber production according to claim 3, which is applied to an acrylic filament by 0.90 to 1.10 weight percent pickup to obtain an oxidized filament having a bending strength not lower than 40 g.

26. An acrylic-fiber finish for carbon-fiber production according to claim 3, the finish which is formed into an aqueous emulsion.

27. A method of manufacturing carbon fiber comprising the steps of applying a finish for acrylic fiber to be processed into carbon fiber according to claim 3 to acrylic fiber to be processed into carbon fiber; oxidative-stabilizing the finish-applied acrylic fiber in an oxidizing atmosphere at 200 to 300 deg. C. to convert the fiber into oxidized fiber; and carbonizing the oxidized fiber in an inert atmosphere at 200 to 3000 deg. C.

28. A method of manufacturing carbon fiber according to claim 27, wherein an oxidized fiber obtained after the oxidative-stabilizing step has a bending strength not lower than 40 g.

29. An acrylic-fiber finish for carbon-fiber production according to claim 11, wherein the surfactant constitutes 5 to 40 weight percent of the whole of a nonvolatile matter of the finish, and includes a nonionic surfactant.

* * * * *